US009450291B2

(12) United States Patent
Korva et al.

(10) Patent No.: US 9,450,291 B2
(45) Date of Patent: Sep. 20, 2016

(54) MULTIBAND SLOT LOOP ANTENNA APPARATUS AND METHODS

(75) Inventors: Heikki Korva, Tupos (FI); Petteri Annamaa, Oulunsalo (FI)

(73) Assignee: PULSE FINLAND OY, Kempele (FI)

( * ) Notice: Subject to any disclaimer, the term of this patent is extended or adjusted under 35 U.S.C. 154(b) by 1007 days.

(21) Appl. No.: 13/190,363

(22) Filed: Jul. 25, 2011

(65) Prior Publication Data

US 2013/0027254 A1 Jan. 31, 2013

(51) Int. Cl.

| | |
|---|---|
| ***H01Q 1/24*** | (2006.01) |
| ***H01Q 1/00*** | (2006.01) |
| ***H01Q 7/00*** | (2006.01) |
| ***H01Q 5/00*** | (2015.01) |
| ***H01Q 9/30*** | (2006.01) |
| ***H01Q 5/371*** | (2015.01) |

(52) U.S. Cl.

CPC ..... *H01Q 1/243* (2013.01); *H01Q 5/371* (2015.01); *H01Q 7/00* (2013.01); *H01Q 9/30* (2013.01)

(58) Field of Classification Search

CPC ..... H01Q 1/24
USPC ..... 343/702
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |

(Continued)

FOREIGN PATENT DOCUMENTS

| | | |
|---|---|---|
| CN | 1823445 | 8/2006 |
| CN | 1983714 | 6/2007 |

(Continued)

OTHER PUBLICATIONS

"An Adaptive Microstrip Patch Antenna for Use in Portable Transceivers", Rostbakken et al., Vehicular Technology Conference, 1996, Mobile Technology for The Human Race, pp. 339-343.

(Continued)

*Primary Examiner* — Dameon E Levi
*Assistant Examiner* — Andrea Lindgren Baltzell
(74) *Attorney, Agent, or Firm* — Gazdzinski & Associates, PC

(57) ABSTRACT

A multiband slot loop antenna apparatus, and methods of tuning and utilizing the same. In one embodiment, the antenna configuration is used within a handheld mobile device (e.g., cellular telephone or smartphone). The antenna comprises two radiating structures: a ring or loop structure substantially enveloping an outside perimeter of the device enclosure, and a tuning structure disposed inside the enclosure. The ring structure is grounded to the ground plane of the device so as to create a virtual portion and an operating portion. The tuning structure is spaced from the ground plane, and includes a plurality of radiator branches effecting antenna operation in various frequency bands; e.g., at least one lower frequency band and three upper frequency bands. On one implementation, a second lower frequency band radiator is effected using a reactive matched circuit coupled between a device feed and a radiator branch.

29 Claims, 7 Drawing Sheets

(56) References Cited

U.S. PATENT DOCUMENTS 4,123,758 A 10/1978 Shibano et al.
4,131,893 A 12/1978 Munson et al.
4,201,960 A 5/1980 Skutta et al.
4,255,729 A 3/1981 Fukasawa et al.
4,313,121 A 1/1982 Campbell et al.
4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,862,181 A 8/1989 PonceDeLeon et al.
4,879,533 A 11/1989 De Muro et al.
4,896,124 A 1/1990 Schwent
4,954,796 A 9/1990 Green et al.
4,965,537 A 10/1990 Kommrusch
4,977,383 A 12/1990 Niiranen
4,980,694 A 12/1990 Hines
5,017,932 A 5/1991 Ushiyama et al.
5,047,739 A 9/1991 Kuokkanene
5,053,786 A 10/1991 Silverman et al.
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,517,683 A 5/1996 Collett et al.
5,521,561 A 5/1996 Yrjola
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa et al.
5,689,221 A 11/1997 Niiranen
5,694,135 A 12/1997 Dikun et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola

(56) References Cited

U.S. PATENT DOCUMENTS 6,031,496 A 2/2000 Kuittinen et al.
6,034,637 A 3/2000 McCoy et al.
6,037,848 A 3/2000 Alila
6,043,780 A 3/2000 Funk et al.
6,072,434 A 6/2000 Papatheodorou
6,078,231 A 6/2000 Pelkonen
6,091,363 A 7/2000 Komatsu et al.
6,097,345 A 8/2000 Walton
6,100,849 A 8/2000 Tsubaki et al.
6,112,106 A 8/2000 Crowley et al.
6,133,879 A 10/2000 Grangeat et al.
6,134,421 A 10/2000 Lee et al.
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,769 B1 11/2002 Lehtola
6,480,155 B1 11/2002 Eggleston
6,501,425 B1 12/2002 Nagumo
6,518,925 B1 2/2003 Annamaa
6,529,168 B2 3/2003 Mikkola
6,535,170 B2 3/2003 Sawamura et al.
6,538,604 B1 3/2003 Isohatala
6,549,167 B1 4/2003 Yoon
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama
6,876,329 B2 4/2005 Milosavljevic
6,882,317 B2 4/2005 Koskiniemi
6,891,507 B2 5/2005 Kushihi et al.
6,897,810 B2 5/2005 Dai et al.
6,900,768 B2 5/2005 Iguchi et al.
6,903,692 B2 6/2005 Kivekas
6,911,945 B2 6/2005 Korva
6,922,171 B2 7/2005 Annamaa
6,925,689 B2 8/2005 Folkmar
6,927,729 B2 8/2005 Legay
6,937,196 B2 8/2005 Korva
6,950,066 B2 9/2005 Hendler et al.
6,950,068 B2 9/2005 Bordi
6,952,144 B2 10/2005 Javor
6,952,187 B2 10/2005 Annamaa
6,958,730 B2 10/2005 Nagumo et al.
6,961,544 B1 11/2005 Hagstrom
6,963,308 B2 11/2005 Korva
6,963,310 B2 11/2005 Horita et al.
6,967,618 B2 11/2005 Ojantakanen
6,975,278 B2 12/2005 Song et al.
6,985,108 B2 1/2006 Mikkola
6,992,543 B2 1/2006 Luetzelschwab et al.
6,995,710 B2 2/2006 Sugimoto et al.
7,023,341 B2 4/2006 Stilp
7,031,744 B2 4/2006 Kuriyama et al.
7,042,403 B2 5/2006 Colburn et al.
7,053,841 B2 5/2006 Ponce De Leon et al.
7,054,671 B2 5/2006 Kaiponen et al.
7,057,560 B2 6/2006 Erkocevic
7,081,857 B2 7/2006 Kinnunen et al.
7,084,831 B2 8/2006 Takagi et al.
7,099,690 B2 8/2006 Milosavljevic
7,113,133 B2 9/2006 Chen et al.
7,119,749 B2 10/2006 Miyata et al.
7,126,546 B2 10/2006 Annamaa
7,136,019 B2 11/2006 Mikkola
7,136,020 B2 11/2006 Yamaki
7,142,824 B2 11/2006 Kojima et al.
7,148,847 B2 12/2006 Yuanzhu
7,148,849 B2 12/2006 Lin
7,148,851 B2 12/2006 Takaki et al.
7,170,464 B2 1/2007 Tang et al.
7,176,838 B1 2/2007 Kinezos
7,180,455 B2 2/2007 Oh et al.
7,193,574 B2 3/2007 Chiang et al.
7,205,942 B2 4/2007 Wang et al.
7,218,280 B2 5/2007 Annamaa

(56) References Cited

U.S. PATENT DOCUMENTS

| | | | | |
|---|---|---|---|---|
| 7,218,282 | B2 | 5/2007 | Humpfer et al. | |
| 7,224,313 | B2 | 5/2007 | McKinzie, III et al. | |
| 7,230,574 | B2 | 6/2007 | Johnson | |
| 7,237,318 | B2 | 7/2007 | Annamaa | |
| 7,256,743 | B2 | 8/2007 | Korva | |
| 7,274,334 | B2 | 9/2007 | O'Riordan et al. | |
| 7,283,097 | B2 | 10/2007 | Wen et al. | |
| 7,289,064 | B2 | 10/2007 | Cheng | |
| 7,292,200 | B2 | 11/2007 | Posluszny et al. | |
| 7,319,432 | B2 | 1/2008 | Andersson | |
| 7,330,153 | B2 | 2/2008 | Rentz | |
| 7,333,067 | B2 | 2/2008 | Hung et al. | |
| 7,339,528 | B2 | 3/2008 | Wang et al. | |
| 7,340,286 | B2 | 3/2008 | Korva et al. | |
| 7,345,634 | B2 | 3/2008 | Ozkar et al. | |
| 7,352,326 | B2 | 4/2008 | Korva | |
| 7,358,902 | B2 | 4/2008 | Erkocevic | |
| 7,382,319 | B2 | 6/2008 | Kawahata et al. | |
| 7,385,556 | B2 | 6/2008 | Chung et al. | |
| 7,388,543 | B2 | 6/2008 | Vance | |
| 7,391,378 | B2 | 6/2008 | Mikkola | |
| 7,405,702 | B2 | 7/2008 | Annamaa et al. | |
| 7,417,588 | B2 | 8/2008 | Castany et al. | |
| 7,423,592 | B2 | 9/2008 | Pros et al. | |
| 7,432,860 | B2 | 10/2008 | Huynh | |
| 7,439,929 | B2 | 10/2008 | Ozkar | |
| 7,468,700 | B2 | 12/2008 | Milosavljevic | |
| 7,468,709 | B2 | 12/2008 | Niemi | |
| 7,498,990 | B2 | 3/2009 | Park et al. | |
| 7,501,983 | B2 | 3/2009 | Mikkola | |
| 7,502,598 | B2 | 3/2009 | Kronberger | |
| 7,589,678 | B2 | 9/2009 | Perunka | |
| 7,616,158 | B2 | 11/2009 | Mark et al. | |
| 7,633,449 | B2 | 12/2009 | Oh | |
| 7,663,551 | B2 | 2/2010 | Nissinen | |
| 7,679,565 | B2 | 3/2010 | Sorvala | |
| 7,692,543 | B2 | 4/2010 | Copeland | |
| 7,710,325 | B2 | 5/2010 | Cheng | |
| 7,724,204 | B2 | 5/2010 | Annamaa | |
| 7,760,146 | B2 | 7/2010 | Ollikainen | |
| 7,764,245 | B2 | 7/2010 | Loyet | |
| 7,786,938 | B2 | 8/2010 | Sorvala | |
| 7,800,544 | B2 | 9/2010 | Thornell-Pers | |
| 7,830,327 | B2 | 11/2010 | He | |
| 7,889,139 | B2 | 2/2011 | Hobson et al. | |
| 7,889,143 | B2 | 2/2011 | Milosavljevic | |
| 7,901,617 | B2 | 3/2011 | Taylor | |
| 7,916,086 | B2 | 3/2011 | Koskiniemi et al. | |
| 7,963,347 | B2 | 6/2011 | Pabon | |
| 7,973,720 | B2 | 7/2011 | Sorvala | |
| 8,049,670 | B2 | 11/2011 | Jung et al. | |
| 8,179,322 | B2 | 5/2012 | Nissinen | |
| 8,270,914 | B2 | 9/2012 | Pascolini et al. | |
| 2001/0050636 | A1 | 12/2001 | Weinberger | |
| 2002/0183013 | A1 | 12/2002 | Auckland et al. | |
| 2002/0196192 | A1 | 12/2002 | Nagumo et al. | |
| 2003/0146873 | A1 | 8/2003 | Blancho | |
| 2004/0090378 | A1 | 5/2004 | Dai et al. | |
| 2004/0145525 | A1 | 7/2004 | Annabi et al. | |
| 2004/0171403 | A1 | 9/2004 | Mikkola | |
| 2005/0057401 | A1 | 3/2005 | Yuanzhu | |
| 2005/0159131 | A1 | 7/2005 | Shibagaki et al. | |
| 2005/0176481 | A1 | 8/2005 | Jeong | |
| 2006/0071857 | A1 | 4/2006 | Pelzer | |
| 2006/0192723 | A1* | 8/2006 | Harada et al. | 343/866 |
| 2007/0042615 | A1 | 2/2007 | Liao | |
| 2007/0082789 | A1 | 4/2007 | Nissila | |
| 2007/0152881 | A1 | 7/2007 | Chan | |
| 2007/0188388 | A1 | 8/2007 | Feng | |
| 2008/0055164 | A1 | 3/2008 | Zhang et al. | |
| 2008/0059106 | A1 | 3/2008 | Wight | |
| 2008/0088511 | A1 | 4/2008 | Sorvala | |
| 2008/0266199 | A1 | 10/2008 | Milosavljevic | |
| 2009/0009415 | A1 | 1/2009 | Tanska | |
| 2009/0066596 | A1* | 3/2009 | Fujishima et al. | 343/767 |
| 2009/0135066 | A1 | 5/2009 | Raappana et al. | |
| 2009/0146902 | A1 | 6/2009 | Li et al. | |
| 2009/0156151 | A1* | 6/2009 | Anguera et al. | 455/289 |
| 2009/0174604 | A1 | 7/2009 | Keskitalo | |
| 2009/0196160 | A1 | 8/2009 | Crombach | |
| 2009/0197654 | A1* | 8/2009 | Teshima et al. | 455/575.7 |
| 2009/0231213 | A1 | 9/2009 | Ishimiya | |
| 2010/0220016 | A1 | 9/2010 | Nissinen | |
| 2010/0244978 | A1 | 9/2010 | Milosavljevic | |
| 2010/0309092 | A1 | 12/2010 | Lambacka | |
| 2011/0102290 | A1 | 5/2011 | Milosavljevic | |
| 2011/0133994 | A1 | 6/2011 | Korva | |
| 2012/0119955 | A1 | 5/2012 | Milosavljevic | |

FOREIGN PATENT DOCUMENTS

| | | | |
|---|---|---|---|
| CN | 1316797 | | 10/2007 |
| CN | 101297440 | | 10/2008 |
| CN | 102110873 | | 6/2011 |
| DE | 10015583 | | 11/2000 |
| DE | 10104862 | | 8/2002 |
| DE | 101 50 149 | A1 | 4/2003 |
| EP | 0208424 | | 1/1987 |
| EP | 0278069 | | 8/1988 |
| EP | 0279050 | | 8/1988 |
| EP | 0339822 | | 3/1989 |
| EP | 0 332 139 | | 9/1989 |
| EP | 0 376 643 | A2 | 4/1990 |
| EP | 0383292 | | 8/1990 |
| EP | 0399975 | | 12/1990 |
| EP | 0400872 | | 12/1990 |
| EP | 0401839 | | 9/1991 |
| EP | 0447218 | | 9/1994 |
| EP | 0615285 | | 10/1994 |
| EP | 0621653 | | 2/1995 |
| EP | 0 749 214 | | 12/1996 |
| EP | 0637094 | | 1/1997 |
| EP | 0 759 646 | A1 | 2/1997 |
| EP | 0 766 341 | | 2/1997 |
| EP | 0 766 340 | | 4/1997 |
| EP | 0751043 | | 4/1997 |
| EP | 0807988 | | 11/1997 |
| EP | 0 831 547 | A2 | 3/1998 |
| EP | 0851530 | | 7/1998 |
| EP | 0856907 | | 8/1998 |
| EP | 1 294 048 | | 1/1999 |
| EP | 0892459 | | 1/1999 |
| EP | 0766339 | | 2/1999 |
| EP | 0 942 488 | A2 | 9/1999 |
| EP | 1 003 240 | A2 | 5/2000 |
| EP | 1006605 | | 6/2000 |
| EP | 1006606 | | 6/2000 |
| EP | 1014487 | | 6/2000 |
| EP | 1024553 | | 8/2000 |
| EP | 1026774 | | 8/2000 |
| EP | 0999607 | | 10/2000 |
| EP | 1 052 723 | | 11/2000 |
| EP | 1052722 | | 11/2000 |
| EP | 1 063 722 | A2 | 12/2000 |
| EP | 1067627 | | 1/2001 |
| EP | 1094545 | | 4/2001 |
| EP | 1 102 348 | | 5/2001 |
| EP | 1098387 | | 5/2001 |
| EP | 1 113 524 | | 7/2001 |
| EP | 1113524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1162688 | | 12/2001 |
| EP | 0993070 | | 4/2002 |
| EP | 1 248 316 | | 9/2002 |
| EP | 0923158 | | 9/2002 |
| EP | 1 267 441 | | 12/2002 |
| EP | 1271690 | | 1/2003 |
| EP | 1 294 049 | A1 | 3/2003 |
| EP | 1306922 | | 5/2003 |
| EP | 1 329 980 | | 7/2003 |
| EP | 1 351 334 | | 8/2003 |

(56) References Cited

FOREIGN PATENT DOCUMENTS

| | | | |
|---|---|---|---|
| EP | 1 361 623 | | 11/2003 |
| EP | 1248316 | | 1/2004 |
| EP | 1396906 | | 3/2004 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1439603 | | 7/2004 |
| EP | 1 445 822 | | 8/2004 |
| EP | 1 453 137 | | 9/2004 |
| EP | 1 469 549 | | 10/2004 |
| EP | 1220456 | | 10/2004 |
| EP | 1467456 | | 10/2004 |
| EP | 1 482 592 | | 12/2004 |
| EP | 1 498 984 | | 1/2005 |
| EP | 1 564 839 | | 1/2005 |
| EP | 1170822 | | 4/2005 |
| EP | 1 544 943 | | 6/2005 |
| EP | 1753079 | | 2/2007 |
| EP | 1 791 213 | | 5/2007 |
| EP | 1843432 | | 10/2007 |
| FI | 20020829 | | 11/2003 |
| FR | 2553584 | | 10/1983 |
| FR | 2724274 | | 3/1996 |
| FR | 2873247 | | 1/2006 |
| GB | 2266997 | | 11/1993 |
| GB | 2 360 422 | A | 9/2001 |
| GB | 239246 | | 12/2003 |
| JP | 59202831 | | 11/1984 |
| JP | 600206304 | | 10/1985 |
| JP | 61245704 | | 11/1986 |
| JP | 06152463 | | 5/1994 |
| JP | 7131234 | | 5/1995 |
| JP | 7221536 | | 8/1995 |
| JP | 7249923 | | 9/1995 |
| JP | 07307612 | | 11/1995 |
| JP | 08216571 | | 8/1996 |
| JP | 09083242 | | 3/1997 |
| JP | 9260934 | | 10/1997 |
| JP | 9307344 | | 11/1997 |
| JP | 10 028013 | | 1/1998 |
| JP | 10107671 | | 4/1998 |
| JP | 10173423 | | 6/1998 |
| JP | 10 209733 | | 8/1998 |
| JP | 10224142 | | 8/1998 |
| JP | 10 327011 | | 12/1998 |
| JP | 10322124 | | 12/1998 |
| JP | 11 004117 | | 1/1999 |
| JP | 114113 | | 1/1999 |
| JP | 11 068456 | | 3/1999 |
| JP | 11127010 | | 5/1999 |
| JP | 11127014 | | 5/1999 |
| JP | 11136025 | | 5/1999 |
| JP | 11 355033 | | 12/1999 |
| JP | 2000278028 | | 10/2000 |
| JP | 200153543 | | 2/2001 |
| JP | 2001267833 | | 9/2001 |
| JP | 2001217631 | | 10/2001 |
| JP | 2001326513 | | 11/2001 |
| JP | 2002319811 | A | 10/2002 |
| JP | 2002329541 | | 11/2002 |
| JP | 2002335117 | | 11/2002 |
| JP | 200360417 | | 2/2003 |
| JP | 2003124730 | | 4/2003 |
| JP | 2003179426 | | 6/2003 |
| JP | 2003318638 | | 11/2003 |
| JP | 2004112028 | | 4/2004 |
| JP | 2004363859 | | 12/2004 |
| JP | 2005005985 | | 1/2005 |
| JP | 2005252661 | | 9/2005 |
| KR | 20010080521 | | 10/2001 |
| KR | 10-2006-7027462 | | 12/2002 |
| KR | 20020096016 | | 12/2002 |
| SE | 511900 | | 12/1999 |
| TW | 201023051 | | 6/2010 |
| WO | WO 92/00635 | | 1/1992 |
| WO | WO 96/27219 | | 9/1996 |
| WO | WO 98/01919 | | 1/1998 |
| WO | WO 98/01921 | | 1/1998 |
| WO | WO 98/37592 | | 8/1998 |
| WO | WO 99/30479 | | 6/1999 |
| WO | WO 00/36700 | | 6/2000 |
| WO | WO 01/20718 | | 3/2001 |
| WO | WO 01/24316 | | 4/2001 |
| WO | WO 01/28035 | | 4/2001 |
| WO | WO 01/29927 | | 4/2001 |
| WO | WO 01/33665 | | 5/2001 |
| WO | WO 01/61781 | | 8/2001 |
| WO | WO 01/91236 | | 11/2001 |
| WO | WO 02/08672 | | 1/2002 |
| WO | WO 02/11236 | A1 | 2/2002 |
| WO | WO 02/13307 | | 2/2002 |
| WO | WO 02/41443 | | 5/2002 |
| WO | WO 02/067385 | | 8/2002 |
| WO | WO 02/078123 | | 10/2002 |
| WO | WO 02/078124 | | 10/2002 |
| WO | WO 02/095870 | A1 | 11/2002 |
| WO | WO 03/094290 | | 11/2003 |
| WO | WO 2004/017462 | | 2/2004 |
| WO | WO 2004/036778 | | 4/2004 |
| WO | WO 2004/057697 | | 7/2004 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/034286 | | 4/2005 |
| WO | WO 2005/038981 | A1 | 4/2005 |
| WO | WO 2005/055364 | | 6/2005 |
| WO | WO 2005/062416 | | 7/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | | 1/2007 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/050600 | | 5/2007 |
| WO | WO 2007/080214 | | 7/2007 |
| WO | WO 2007/098810 | | 9/2007 |
| WO | WO 2007/138157 | | 12/2007 |
| WO | WO 2008/059106 | | 3/2008 |
| WO | WO 2008/129125 | | 10/2008 |
| WO | WO 2009/027579 | | 5/2009 |
| WO | WO 2009/095531 | | 8/2009 |
| WO | WO 2009/106682 | | 9/2009 |
| WO | WO 2010/122220 | | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

(56) References Cited

OTHER PUBLICATIONS

Cheng-Nan Hu, Willey Chen, and Book Tai, "A Compact Multi-Band Antenna Design for Mobile Handsets", *APMC 2005 Proceedings*.
Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.
European Office Action, May 30, 2005 issued during prosecution of EP 04 396 001.2-1248.
Examination Report dated May 3, 2006 issued by the EPO for European Patent Application No. 04 396 079.8.
F.R. Hsiao, et al. "A dual-band planar inverted-F patch antenna with a branch-line slit," *Microwave Opt. Technol. Lett.*, vol. 32, Feb. 20, 2002.
Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.
Guo, Y. X. and H. S. Tan, "New compact six-band internal antenna," *IEEE Antennas and Wireless Propagation Letters*, vol. 3, 295-297, 2004.
Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.
Hoon Park, et al. "Design of an Internal antenna with wide and multiband characteristics for a mobile handset", *IEEE Microw. & Opt. Tech. Lett.* vol. 48, No. 5, May 2006.
Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*., Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/CPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in 2000 *IEEE Antennas Propagat Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi Kumar, et al. "Broadband Concentric Rings Fractal Slot Antenna," Department of Electrical Engineering, Indian Institute of Technology, Kanpur-208 016, India.
Singh, Rajender, "Broadband Planar Monopole Antennas," M. Tech credit seminar report, Electronic Systems group, EE Dept, IIT Bombay, Nov. 2003, pp. 1-24.
Gobien, Andrew, T. "Investigation of Low Profile Antenna Designs for Use in Hand-Held Radios," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz", Nordic Semiconductor, White Paper, 2005, pp. 1-6.
White, Carson, R., "Single- and Dual-Polarized Slot and Patch Antennas with Wide Tuning Ranges," The University of Michigan, 2008.

* cited by examiner

MULTIBAND SLOT LOOP ANTENNA APPARATUS AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to antenna apparatus for use in electronic devices such as wireless or portable radio devices, and more particularly in one exemplary aspect to a multiband slotted loop or ring antenna, and methods of tuning and utilizing the same.

DESCRIPTION OF RELATED TECHNOLOGY

Internal antennas are an element found in most modern radio devices, such as mobile computers, mobile phones, Blackberry® Blackberry devices, smartphones, personal digital assistants (PDAs), or other personal communication devices (PCDs). Typically, these antennas comprise a planar radiating plane and a ground plane parallel thereto, which are connected to each other by a short-circuit conductor in order to achieve the matching of the antenna. The structure is configured so that it functions as a resonator at the desired operating frequency. It is also a common requirement that the antenna operate in more than one frequency band (such as dual-band, tri-band, or quad-band mobile phones), in which case two or more resonators are used.

Recent advances in the development of affordable and power-efficient display technologies for mobile applications (such as liquid crystal displays (LCD), light-emitting diodes (LED) displays, organic light emitting diodes (OLED), thin film transistors (TFT), etc.) have resulted in a proliferation of mobile devices featuring large displays, with screen sizes of for instance 89-100 mm (3.5-4 in.) in mobile phones, and on the order of 180 mm (7 in.) in some tablet computers. To achieve the best performance, display ground planes (or shields) are commonly used. These larger ground planes are required by modern displays, yet are no longer optimal for wireless antenna operation. Specifically, this lack of optimization stems from the fact that ground plane size plays a significant role in the design of the antenna for the air interface(s) of the device. As a result, antenna bandwidth is reduced due to, at least in part, impedance mismatch between antenna radiator and the large ground plane.

Furthermore, current trends increase demand for thinner mobile communications devices with large displays that are often used for user input (e.g., touch screen). This in turn requires a rigid structure to support the display assembly, particularly during the touch-screen operation, so as to make the interface robust and durable, and mitigate movement or deflection of the display. A metal body or a metal frame is often utilized in order to provide a better support for the display in the mobile device.

The use of metal enclosures/chassis, large ground planes, and the requirement for thinner device enclosure create new challenges for radio frequency (RF) antenna implementations. Typical antenna solutions (such as monopole, PIFA antennas) require ground clearance area and sufficient height from ground plane in order to operate efficiently in multiple frequency bands (a typical requirement of modern portable devices). These antenna solutions are often inadequate for the aforementioned thin devices with metal housings and/or chassis, as the vertical distance required to separate the radiator from the ground plane is no longer available. Additionally, the metal body of the mobile device acts as an RF shield and degrades antenna performance, particularly when the antenna is required to operate in several frequency bands Various methods are presently employed to attempt to improve antenna operation in thin communication devices that utilize metal housings and/or chassis, such as for example a slot ring antenna described in European Patent Publication number EP1858112B1. This implementation requires fabrication of a slot within the printed wired board (PWB) in proximity to the feed point, as well as along the entire height of the device. For a device having a larger display, a slot location that is required for optimal antenna operation often interferes with device user interface functionality (e.g. buttons, scroll wheel, etc), therefore limiting device layout implementation flexibility.

Additionally, such metal housing must have openings in close proximity to the slot on both sides of the PCB. To prevent generation of radio frequency cavity modes within the device, the openings are typically connected using metal walls. All of these steps increase device complexity and cost, and impede antenna matching to the desired frequency bands of operation.

Another existing implementation employs a multi-resonant coupled feed antenna comprising a metal ring radiating element fitted around perimeter of the radio device. Several slots are fabricated within the radiator (typically on the sides) in order to achieve multiband antenna functionality; this approach unfortunately increases the cost and complexity of the device. Given that device users typically handle communication devices by their sides/edges, such configuration is susceptible to antenna detuning and communication failures due to a short circuit created when a user hand touches the radiator over the slot. Furthermore, wide slots (typically about 3 mm in width) are required to achieve the desired low band (typically 700-960 MHz) operation, and as such may adversely affect device aesthetic appeal.

Accordingly, there is a salient need for a wireless multiband antenna solution for e.g., a portable radio device, with a small form factor and which is suitable for the device perimeter, and that offers a lower cost and complexity, as well as providing for improved control of antenna resonance.

SUMMARY OF THE INVENTION

The present invention satisfies the foregoing needs by providing, inter alia, a space-efficient multiband antenna apparatus, and methods of tuning and use thereof.

In a first aspect of the invention, a mobile communications device is disclosed. In one embodiment, the device comprises: an enclosure and an electronics assembly contained substantially therein, the electronics assembly comprising a ground plane and at least one feed port; and a multiband antenna apparatus. The multiband antenna apparatus comprises: a first antenna structure comprising an element disposed substantially around an outside perimeter of the enclosure; and a second antenna structure comprising a plurality of monopole radiator branches. In one variant, the first antenna structure is connected to the ground plane in at least two ground points, thereby forming a virtual portion and an operational portion, the operational portion comprising a slot disposed in the element proximate a bottom side of the enclosure; an exterior perimeter of the virtual portion substantially envelops the ground plane; and an exterior perimeter of the operational portion is disposed external to the ground plane, and substantially envelops the second antenna structure.

In another embodiment, the mobile device comprises: a device enclosure; and an antenna having a substantially external radiator element, the radiator element having at least one slot disposed relative to the enclosure so as to minimize the potential for radiator element shorting across the slot due to device handling by a user during use of the device.

In one variant of the alternate embodiment, the radiator element comprises a substantially closed loop, and the at least one slot comprises a single slot disposed substantially on a bottom edge of the enclosure of the device, the bottom edge being not normally grasped by the user during the use of the device.

In another variant, the radiator element comprises a substantially closed loop disposed on top, bottom and side edges of the enclosure of the mobile device; and the at least one slot comprises a single slot disposed at either one of the top or the bottom edges.

In a second aspect of the invention, a multiband antenna apparatus is disclosed. In one embodiment, the apparatus is adapted for use in a portable radio communications device, and comprises: a first antenna structure comprising an element configured to be disposed substantially around an outside perimeter of a device enclosure. In one variant, the first antenna structure is connected to a ground plane of the device in at least two locations, thereby forming a virtual portion and an operational portion; and the operational portion comprises a slot formed in the element so as to be disposed proximate a bottom side of the enclosure.

In another variant, an exterior perimeter of the virtual portion substantially envelops the ground plane; and an exterior perimeter of the second antenna structure is disposed external to the ground plane.

In yet another variant, the slot is configured to effect antenna resonance in at least one upper frequency band.

In a third aspect of the invention, a method of operating a multiband antenna apparatus is disclosed. In one embodiment, the antenna apparatus if for use in a portable radio device and has a feed, a loop radiator element disposed substantially around a perimeter region of an enclosure of the device. The loop radiator element has a slot disposed substantially at a bottom edge of the enclosure, and a ground plane of the radio device is disposed a distance away from a bottom edge of the loop radiator element. The method comprises: energizing the feed with a feed signal comprising a lower frequency component and a higher frequency component; and causing radio frequency oscillations in the loop radiator element at least at the higher frequency. The slot is configured to effect tuning of the antenna apparatus in the range of the higher frequency.

In a fourth aspect of the invention, a method of mitigating the effects of user interference on a radiating and receiving mobile device is disclosed. In one embodiment, the mobile device is characterized by a preferred user grasping location, and the method comprises: energizing a loop antenna element with a signal comprising at least a first frequency component; the loop radiator element being disposed substantially around a perimeter region of an enclosure of the device, and causing an electromagnetic field across a slot formed within the loop antenna element. The slot is distally located relative to the preferred grasping location so as to mitigate electromagnetic interference due to the grasping by the user.

In a fifth aspect of the invention, a method of tuning a multiband antenna apparatus is disclosed.

Further features of the present invention, its nature and various advantages will be more apparent from the accompanying drawings and the following detailed description.

BRIEF DESCRIPTION OF THE DRAWINGS

The features, objectives, and advantages of the invention will become more apparent from the detailed description set forth below when taken in conjunction with the drawings, wherein.

Figure 1A:
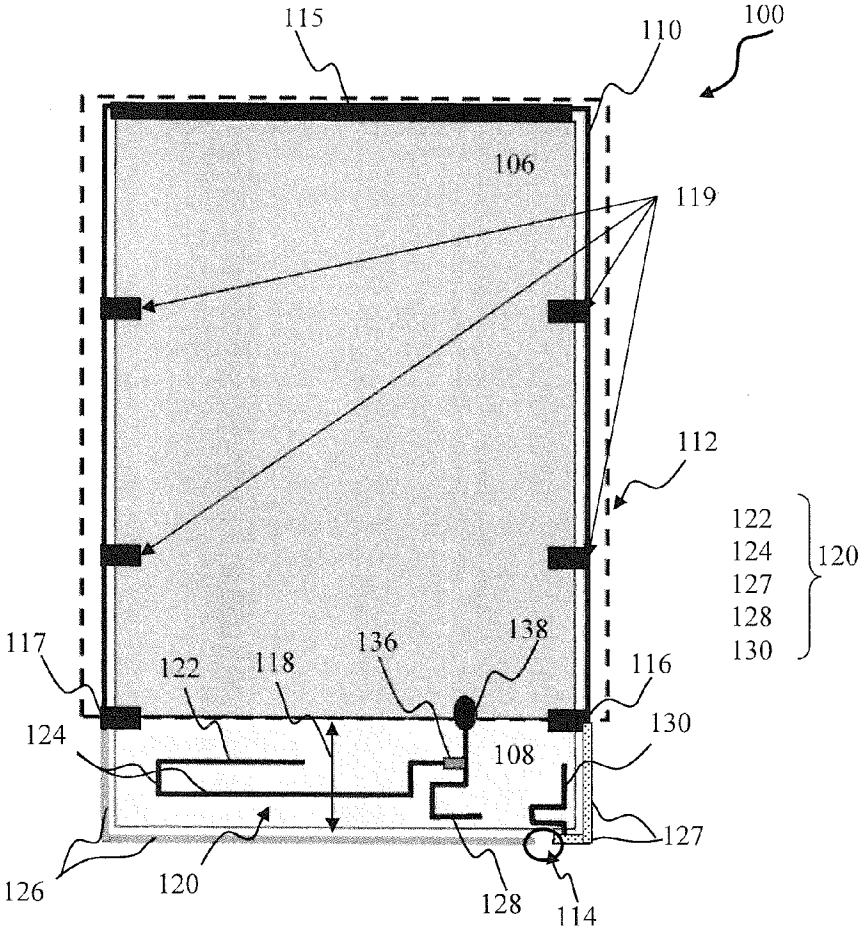
FIG. 1A is a top plan view of a mobile device showing antenna apparatus of the embodiment of FIG. 1.

All Figures disclosed herein are © Copyright 2011 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," "antenna system," "antenna assembly", and "multi-band antenna" refer without limitation to any apparatus or system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna or portion thereof.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "loop" and "ring" refer generally and without limitation to a closed (or virtually closed) path, irrespective of any shape or dimensions or symmetry.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Overview

The present invention provides, in one salient aspect, a multiband antenna apparatus for use in a mobile radio device. The antenna apparatus advantageously provides reduced complexity and cost, and improved antenna performance, as compared to prior art solutions. In one embodiment, the mobile radio device comprises a metallic structure (e.g., a loop or ring) that at least partly encircles the outside perimeter of the device enclosure, and acts as the antenna radiating element. The "loop" radiator in one implementation comprises a single narrow slot disposed so as to minimize potential radiator shorting over the slot due to device handling during use, and to improve device visual appeal.

The exemplary embodiment of the multiband antenna apparatus further comprises a tuning circuit, including multiple branches each configured to effect antenna tuning in a predetermined frequency band. The metallic loop is grounded to the device ground plane at multiple locations, thus controlling the electrical length of the antenna. The dimensions of the slot are selected to optimize antenna performance in an upper frequency band of operation. The slot location effects low band lower band resonance frequency, which is configured to reside well below the lowest operating frequency of the antenna for proper operation of the radio device. In one approach, antenna lower band operation is tuned using an inductor connected in series between the feed and the lower band resonance circuit.

Advantageously, antenna coupling to the device electronics with the exemplary antenna disclosed herein is much simplified, as only a single feed connection is required (albeit not limited to a single feed). In one particular implementation, an upper frequency band tuning strip is galvanically connected to the loop element, thereby enabling tuning of the highest upper band resonances without changing or adversely affecting the visual appearance of the device In another implementation, the tuning element is capacitively coupled via an electromagnetic field induced over a non-conductive gap between the tuning strip and the loop radiator.

Methods of tuning and operating the antenna apparatus are also disclosed.

DETAILED DESCRIPTION OF EXEMPLARY EMBODIMENTS

Detailed descriptions of the various embodiments and variants of the apparatus and methods of the invention are now provided. While primarily discussed in the context of mobile devices, the various apparatus and methodologies discussed herein are not so limited. In fact, many of the apparatus and methodologies described herein are useful in any number of complex antennas, whether associated with mobile or fixed devices, cellular or otherwise.

Exemplary Antenna Apparatus

Figure 1:
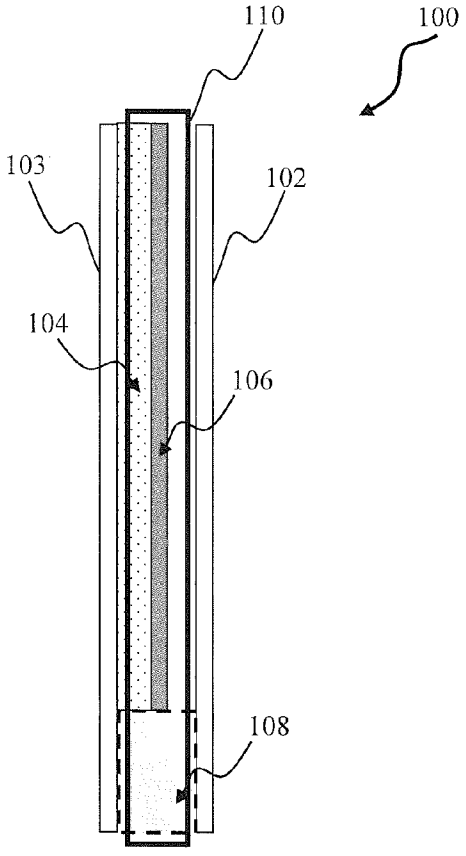
FIG. 1 is a side elevation view of a mobile device detailing a ring antenna apparatus configured according to one embodiment of the invention and installed therein.
Figure 2:
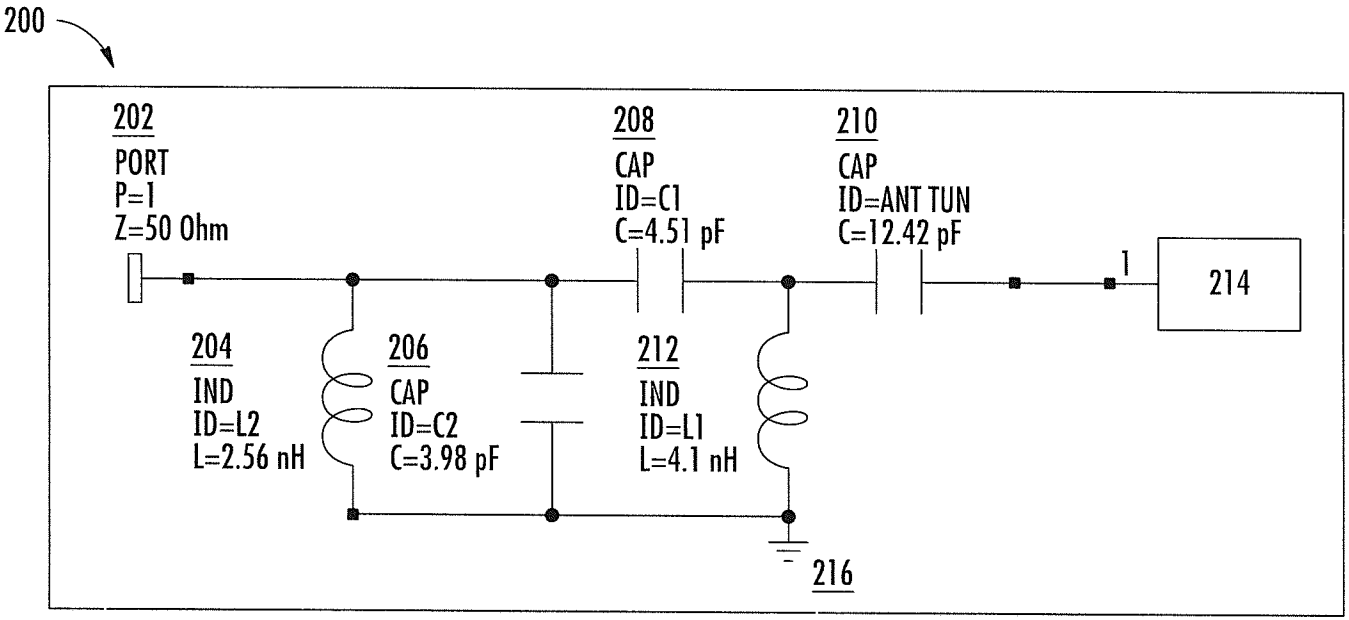
FIG. 2 is a schematic diagram detailing a multiband matching circuit according to one embodiment of the invention.

Referring now to FIGS. 1 through 2, exemplary embodiments of the radio antenna apparatus of the invention are described in detail. One exemplary embodiment of the antenna apparatus for use in a mobile radio device is presented in FIG. 1, showing a side elevation view of the host mobile device 100. The device 100 comprises a display module 104 and a corresponding ground plane 106 disposed in-between two dielectric covers 102, 103. In one variant, one of the dielectric covers 103 comprises an opening corresponding to the display perimeter, so as to enable e.g., touch-screen or other interactive functionality. Notwithstanding, the display 104 may comprise e.g., a display-only device configured only to display information, a touch screen display (e.g., capacitive or other technology) that allows users to provide input into the device via the display 104, or yet other technology. The display 104 may comprise, for example, a liquid crystal display (LCD), light-emitting diode (LED) display, LED-LCD display, organic light emitting diode (OLED) display, or TFT-based device. It is appreciated by those skilled in the art that methodologies of the present invention are equally applicable to any future display technology, provided the display module is generally mechanically compatible with device and antenna configurations such as those described in FIG. 1 through FIG. 2.

A metal loop or ring 110 is disposed substantially at the outside perimeter of the device housing, as shown in FIG. 1.

The ring structure of this embodiment provides mechanical rigidity, structural integrity for the device, as well as enhances aesthetic appeal. In one variant (not shown), the ring 110 is replaced with a metal segment (e.g., a portion of the loop) encompassing a portion of the device perimeter.

The ring 110 of FIG. 1 can be fabricated using any of a variety of suitable methods including for example metal casting, stamping, metal strip, or a conductive coating disposed on a non-conductive carrier (such as plastic).

FIG. 1A is a top plan view detailing the exemplary antenna structure of the embodiment of FIG. 1. The ring 110 is connected to the ground plane 106 at multiple locations 116, 117, 119. Furthermore, the top portion of the ring is attached to the ground plane along the top perimeter structure 115.

The ground points 116, 117 are used for antenna tuning, and their locations effectively define the length of the ring or loop antenna operational portion (i.e., the portion of the antenna that emits/receives RF radiation). The ground points 115, 119 are preferably separated by a distance that is less than a quarter wavelength of the antenna (at the highest operating frequency). In one variant, the ground structure 115 is configured to cover the majority of the upper edge of the ring, as shown in FIG. 1A. In another variant (not shown), the ground point 115 grounds a portion of the upper ring edge.

The ring upper part (i.e., bounded by the ground points 116, 117, 119, 115 and marked by the broken line rectangle 112 in FIG. 1A) forms a grounded (or virtual) portion. The virtual antenna portion is configured to be at the same potential as the ground plane. Such configuration minimizes unwanted antenna RF radiation being emitted from the antenna grounded portion and further reduces antenna susceptibility to shorting and loading effects due to handling of the mobile device by users during operation. In one variant, the upper ring portion may be removed as required by the enclosure design to simplify assembly and reduce cost of the radio device. In another variant, the ring is used to provide device structural support and visual appeal.

As a brief aside, the antenna of the embodiment shown in FIGS. 1-1A is configured to operate in both low and high frequency (relative to one another) operational ranges. In one variant, the low operating frequency range is between about 800 MHz and about 960 MHz, and the high operational frequency range is between about 1700 MHz and 2200 MHz. As will be appreciated by those skilled in the art, the above frequency bounds are exemplary, and can be changed from one implementation to another based on specific design requirements and parameters, such as for example antenna size, target country of device operation, etc. Typically, each of the operational frequency ranges may support one or more distinct frequency bands configured in accordance with the specifications governing the relevant wireless application system (such as, for example, LTE/LTE-A or GSM). One antenna embodiment, shown and described with respect to FIG. 1A herein, may support one or two lower frequency bands (LFB1, LFB2) and at least three upper frequency bands (UFB1, UFB2, UFB3). In another embodiment, the high frequency operational range (e.g., between about 2500 MHz and about 2700 MHz) is used to enable antenna operation in a fourth upper frequency band (UFB4).

Returning now to FIG. 1A, the bottom part of the loop or ring structure (disposed below the virtual portion 112) forms an operational structure of the antenna radiator, and is referred to herein as the ring or loop operational portion. One ground point 116 determines the electrical length of the operational portion in the high frequency range, while another ground point 117 determines the antenna electrical length in the low frequency range. The ring 110 of this embodiment comprises a narrow slot 114 disposed along the bottom edge of the host device, and is configured to effect antenna tuning in the high frequency range. In one variant, the slot is about 0.8 mm in width, although other values may be used depending on the desired performance and physical attributes. In order to maintain device aesthetic appeal and to increase structural integrity of the enclosure, the slot may be filled with a dielectric material (such as e.g., plastic).

Moreover, the present invention contemplates the use of (i) a slot with a varying or non-constant width (that is: different slot width at different locations across the ring thickness); and (ii) use of two or more slots.

In the embodiment of FIG. 1A, the ground plane 106 is spaced from the bottom edge of the ring 110 by a prescribed distance 118; e.g., about 13 mm. The ground-free bottom portion 108 of the device houses the antenna tuning structure 120. The tuning structure 120 is configured to effect simultaneous operation of the antenna in lower and upper operating frequency bands of the portable radio device 100. The structure 120 is coupled to the feed electronics of the device at a feed point 138, and comprises several tuning branches 122, 124, 128, 130.

Antenna frequency tuning in the illustrated embodiment is achieved as follows: the tuning branch 124 effects antenna tuning in a first lower frequency band (LFB1), which corresponds to antenna low frequency resonance $f_1$. In one variant, the LFB1 comprises frequency band from 824 to 894 MHz, and $f_1$ is centered at about 850 MHz (also referred to as the 850 MHz band). In another variant, the LFB1 comprises frequency band from 880 to 960 MHz, and $f_1$ is centered at about 900 MHz (also referred to as the 900 MHz band).

In one variant of the embodiment of FIG. 1A, a series tuning circuit 136 is disposed between the feed 136 and the horizontal portion of the branch 124. The tuning circuit 136 is configured to adjust the electric length of the lower frequency antenna resonator, and to increase the antenna operational bandwidth in the lower band. This increased lower frequency bandwidth enables antenna operation in two lower frequency bands LFB1, LFB2.

In one implementation, the tuning circuit 136 comprises a coil configured to provide a series inductance of about 10 nano-Henry (nH) to the radiator branch 124, with LFB1 being the 850 MHz band, and LFB2 being the 900 MHz band. As will be appreciated by those skilled in the art, other tuning element implementations are equally applicable to the invention including, but not limited to a discrete inductor, a capacitive element, or a combination thereof.

Antenna operation of the embodiment shown in FIG. 1A in the LFB1 (and LFB2) band is tuned by the overall length of the resonator 124, and the reactance value of the tuning element 136.

The long section 126 (formed between the ground point 117 and the slot 114) of the ring structure bottom portion forms a resonance at frequency $f_0$. In order to achieve desired antenna operation at lower frequencies (e.g., LFB1, LFB2) and to prevent coupled low frequency resonances, the $f_0$ resonance is tuned to be below the antenna low operating frequency range (for example, 820 to 960 MHz). In one variant, the bottom portion resonance frequency $f_0$ is selected at about 600 MHz.]

The antenna high frequency operational range is formed by at least two high frequency resonances, hereinafter referred to as the $f_2$ resonance and the $f_3$ resonance. The first high frequency resonance ($f_2$) is formed by the shorter portion 127 of the ring 110 formed between the slot 114 and the ground point 116. Antenna tuning of this resonance is achieved in the illustrated embodiment by varying the length of the strip in the tuning branch 130. The tuning branch 130 is coupled to the ring 110 either galvanically or capacitively, as described in detail below with respect to FIGS. 1B-1C.

The directly fed antenna high frequency tuning structure 128 is configured to form a resonance at the second high frequency resonance ($f_3$). The value of the $f_3$ resonance is tuned in the illustrated embodiment by the length of the tuning branch 128 (and its proximity to the bottom portion of the ring). Each of the $f_2$ and $f_3$ resonances may be configured to provide antenna functionality in one or more upper frequency bands.

In one variant, the combination of $f_2$ and $f_3$ resonance bands spans a frequency range from about 1710 MHz to 2170 MHz, thus enabling device operation in the following high-frequency bands of an LTE-compliant system: 1710-1880 MHz, 1850-1990 MHz, and 1930-2170 MHz, corresponding to UFB1-UFB3, respectively.

In another embodiment, the directly fed low frequency range radiating structure 122 is used, in combination with the tuning branch 124, to form a harmonic resonance, referred to as the $f_4$ resonance, of a frequency component of the low frequency range, thereby effecting antenna operation in a fourth upper frequency band (UFB4). The value of the UFB4 is tuned by the length of the horizontal branch 122 of the C-shaped structure (having two turns) formed by the tuning branches 122, 124 of FIG. 1A.

Figure 1B:
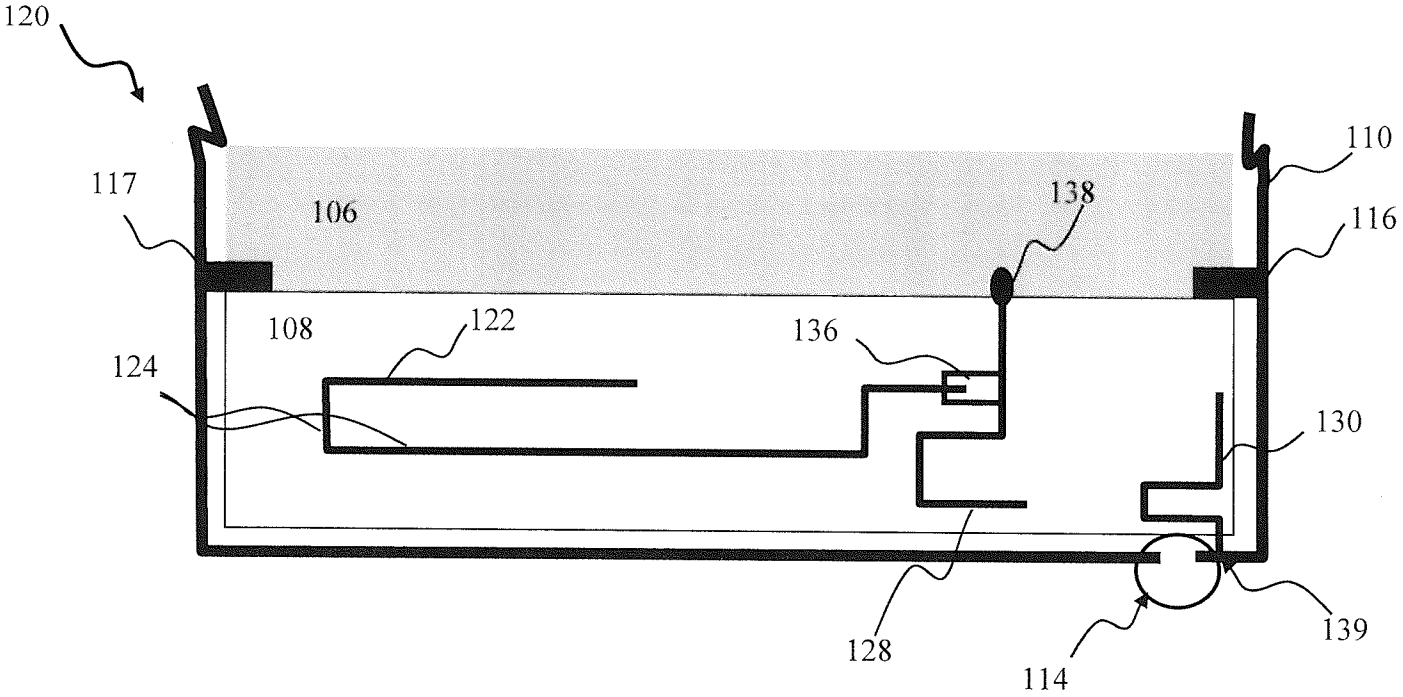
FIG. 1B is a block diagram detailing a multiband ring antenna tuning configuration according to one embodiment of the invention.
Figure 1C:
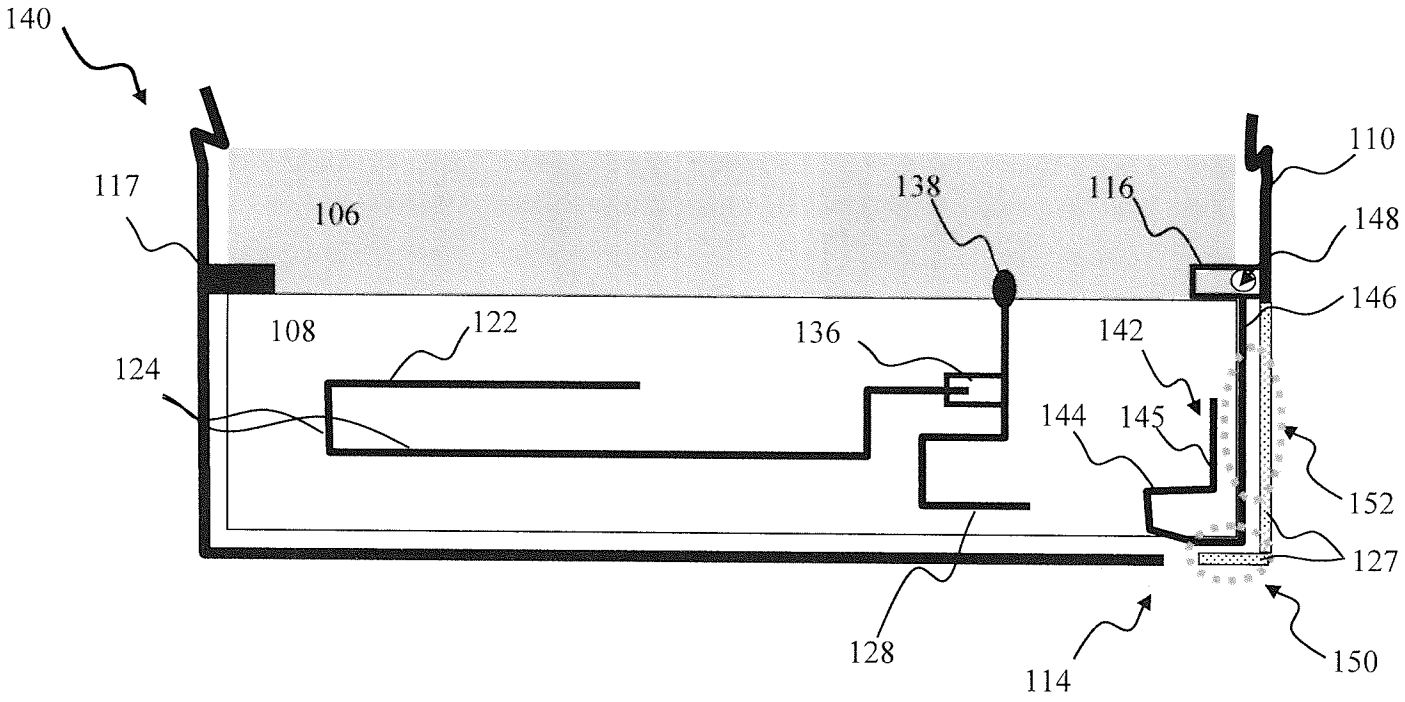
FIG. 1C is a block diagram detailing capacitive coupling of the multiband ring antenna of FIG. 1.

Referring now to FIGS. 1B-1C, two exemplary embodiments of the antenna tuning structure are shown and described. The antenna tuning structure 120 of FIG. 1B corresponds to the antenna embodiment of FIG. 1A and comprises the $f_2$ tuning branch 130 that is directly connected to the ring structure 110 at a point 139.

In another embodiment (shown in FIG. 1C), the tuning branch 142 of the tuning structure 140 comprises two vertical strips 145, 146 and a loop structure 144 disposed there between. The vertical strip 146 is grounded at a ground point 148. The tuning branch 142 is electrically isolated from the ring 110. In one variant, the isolation is effected by a thin layer of dielectric material disposed along the inner surface of the ring 110. The tuning branch 142 is capacitively coupled to the ring 110 via an electric field induced over non-conductive gaps 150, 152. In one implementation, the gap is selected to be about 0.3 mm in width, although other values may be used with equal success.

In the capacitive coupling setup, the dielectric gap between the tuning strip and the operational portion of the metal ring needs to be sufficiently small in order to form the gap resonance above the highest operating frequency of the antenna. Capacitive coupling of the tuning branch to the ring structure does not require any physical attachment (e.g., soldering, welding) of the tuning structure to the ring, therefore advantageously facilitating antenna manufacturing and allowing for a wider range of material selection.

The gap between the ring portion 127 and the tuning branch 142 causes a gap resonance at a frequency that is defined by the capacitance between the surfaces of the ring portion 127 and the tuning branch 142 due to a strong electric field between these surfaces. Reducing the gap creates a tighter coupling between these elements, and shifts the gap resonance frequency higher and beyond the antenna operating bands. The gap resonance frequency is further affected by the size the overlapping surface area (also referred to as the coupling area) between the strips 144, 146 of the tuning branch 142 and the ring portion 127. Larger coupling area allows for a larger gap.

In another embodiment (not shown), the multiband antenna is configured without the tuning element 136, thereby forming a 4-band resonator with a single lower band frequency band LFB1 and three upper frequency bands (UFB1, UFB2, UFB3).

In another aspect of the invention, the antenna structure (such as that shown in FIG. 1A) is fitted with a tuning network in order to optimize antenna performance; e.g., to increase antenna efficiency and reduce losses. FIG. 2 shows one embodiment of such tuning network configured to operate in four or more frequency bands, here within the frequency range from about 800 kHz to 2700 MHz. The network 200 comprises an input port 202, characterized by the nominal impedance of 50 Ohm, which is connected to the feed port of the portable device electronics. The circuit ground point 216 is connected to the device ground plane, and the circuit output port 214 is connected to antenna radiating structure, such as, for example, the feed point 138 in FIG. 1A. The inductive element 204 and the capacitive element 206 form a first resonance circuit (L2C2) configured to effect antenna tuning in the LFB2 and the UFB4 frequency bands. Exemplary values of the capacitive elements 206, 208, 210 and the inductive 204, 212 elements, are as illustrated in FIG. 2. A first inductive element 212 and first capacitive element 208 control impedance transformation between the antenna radiator and the L2C2 circuit. The second capacitive element 210 is used for tuning purposes, and may be omitted in some implementations if desired. It will be recognized that the exact component values and/or tuning network configuration are/is selected based on specific application and parametric requirements, and may change from one application to another, such values being readily determined by those skilled in the electronic arts given this disclosure.

Performance

Figure 3:
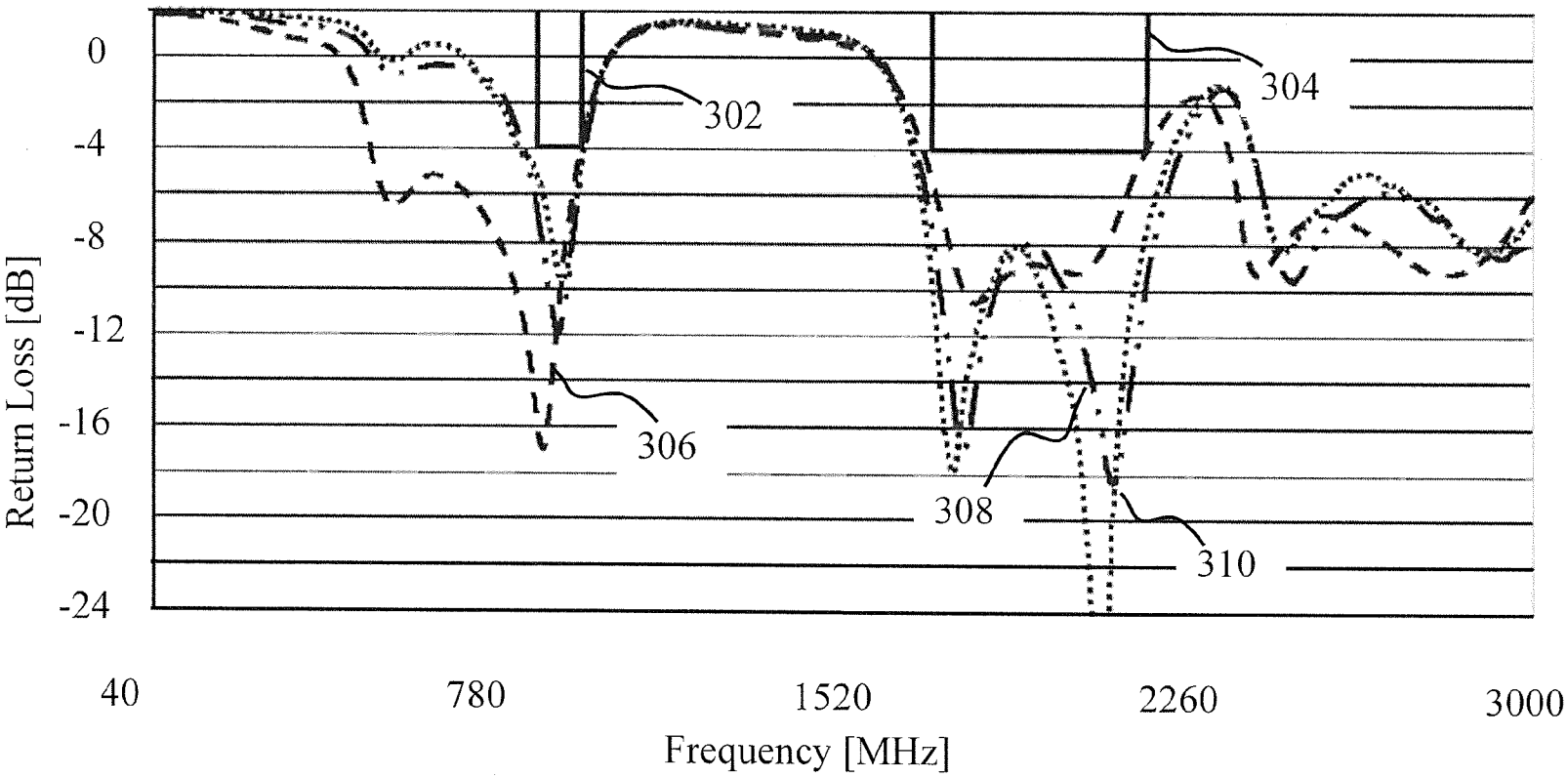
FIG. 3 is a plot of (i) measured free space input return loss, (ii) CTIA v3.1 beside head, right cheek return loss, and (iii) CTIA v3.1 beside head with hand, right cheek return loss measurements, obtained with an exemplary five-band antenna apparatus configured in accordance with the embodiment of FIG. 1A.
Figure 4:
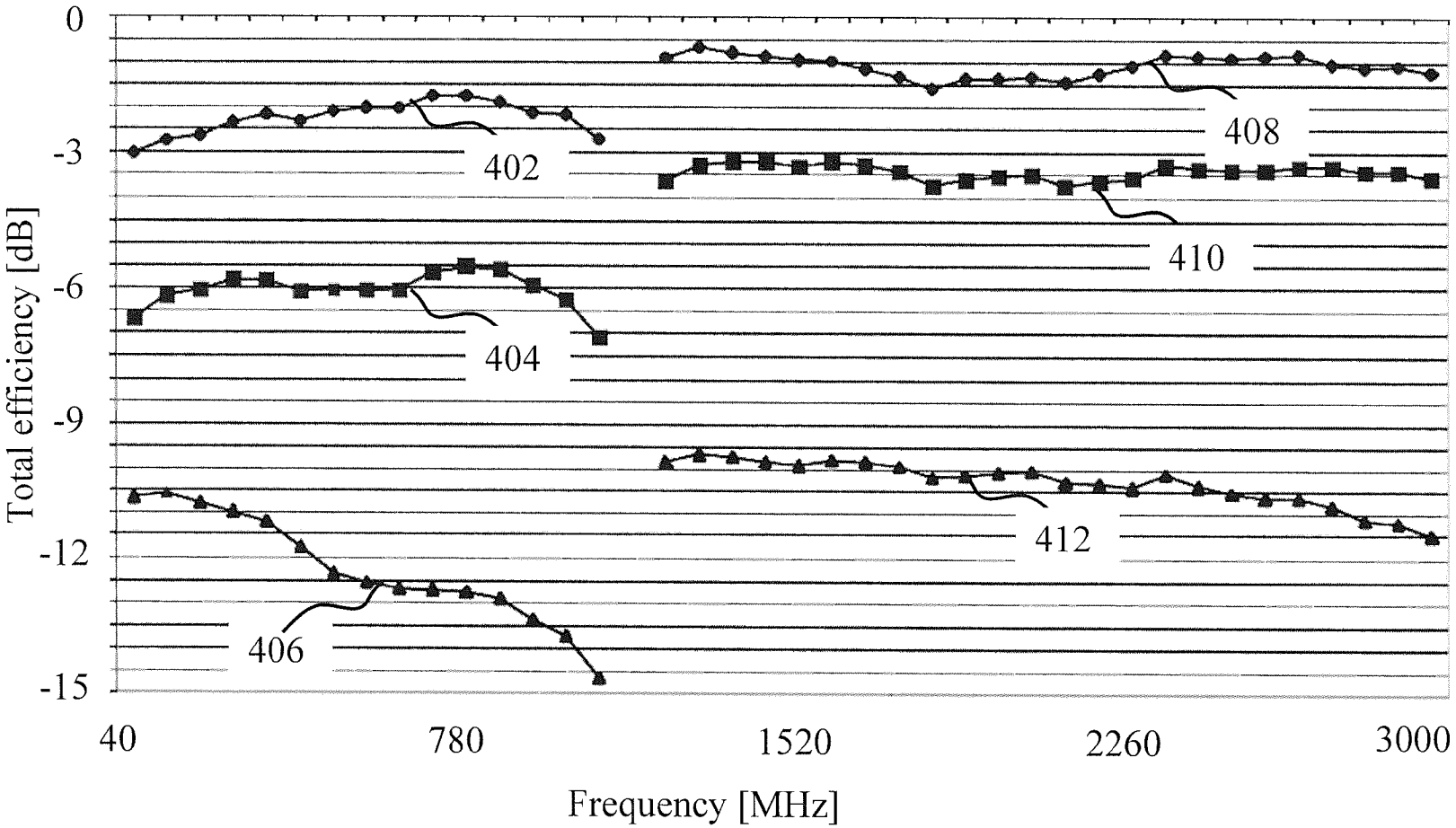
FIG. 4 is a plot of (i) measured total free space efficiency, (ii) CTIA v3.1 beside head, right cheek efficiency, and (iii) CTIA v3.1 beside head with hand, right cheek efficiency measurements, obtained with an exemplary multi-band antenna apparatus configured in accordance with the embodiment of FIG. 1A.
Figure 5:
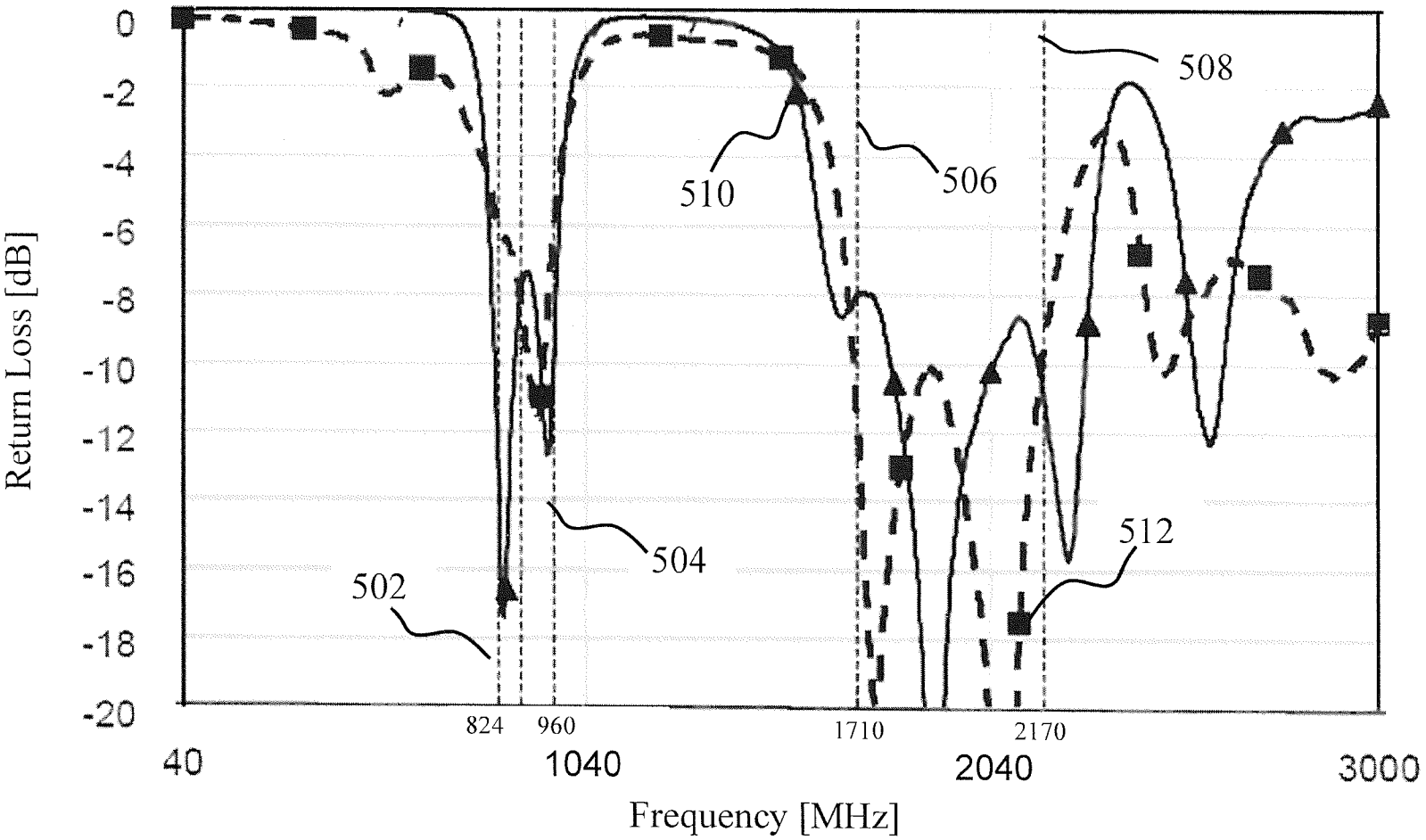
FIG. 5 is a plot of measured free space input return loss of an exemplary five-band antenna apparatus configured in accordance with the embodiment of FIG. 1A, and comprising the tuning circuit of FIG. 2.

FIGS. 3 through 5 present performance results obtained during simulation and testing by the Assignee hereof of an exemplary antenna apparatus constructed according to one embodiment of the invention.

FIG. 3 shows a plot of free-space return loss S11 (in dB) as a function of frequency, measured with the four-band multiband antenna constructed similarly to the embodiment depicted in FIG. 1A. The antenna four frequency bands include one 900 MHz low frequency band, and three upper frequency bands (1710-1880 MHz, 1850-1990 MHz, and 1930-2170 MHz). The solid line designated with the designator 302 in FIG. 3 marks the boundaries of the lower frequency band, while the line designated with the designator 304 marks the boundaries of the high frequency range between 1710 and 2170 MHz. The curves marked with designators 306-310 correspond to measurements obtained in the following device configurations: (i) the first curve 306 is taken in free space; (ii) the second curve 308 is taken according to CTIA v3.1 beside head, right cheek (BHR) measurement configuration; and (iii) the third curve 310 is taken according to CTIA v3.1 beside head with hand, right cheek (BHHR) measurement configuration. Data presented in FIG. 3 demonstrate that the exemplary antenna comprising a single small slot positioned along the bottom of the device is advantageously not detuned off-band by the presence of the user's hand, and a 6 dB return loss is maintained throughout the BHHR measurements.

FIG. 4 presents data regarding measured free-space efficiency for the same antenna as described above with respect to FIG. 3. Efficiency of an antenna (in dB) is defined as decimal logarithm of a ratio of radiated to input power:

$$AntennaEfficiency = 10\log_{10}\left(\frac{\text{Radiated Power}}{\text{Input Power}}\right) \quad \text{Eqn. (1)}$$

An efficiency of zero (0) dB corresponds to an ideal theoretical radiator, wherein all of the input power is radiated in the form of electromagnetic energy.

The curves marked with designators 402-412 in FIG. 4 correspond to measurements obtained in the following device configurations: (i) curves 402, 408 are taken in free space; (ii) curves 404, 410 are taken according to CTIA v3.1 beside head, right cheek (BHR) measurement configuration; and (iii) curves 406-412 are taken according to CTIA v3.1 beside head with hand, right cheek (BHHR) measurement configuration. The data in FIG. 4 demonstrate that the antenna embodiment constructed according with the principles of the present invention is not susceptible to higher losses due to user hand and head proximity, thereby enabling robust operation of the radio device.

FIG. 5 shows a plot of free-space return loss S11 (in dB) as a function of frequency, obtained for the five-band multiband antenna constructed in accordance with the embodiment depicted in FIG. 1A, and utilizing the tuning circuit of the embodiment of FIG. 2 herein. The antenna frequency bands include 850 and 900 MHz (the two low frequency bands), and 1710-1880 MHz, 1850-1990 MHz, and 1930-2170 MHz (the three upper frequency bands). Designators 502, 504 mark the lower (824 MHz) and the upper (960 MHz) extents of the lower frequency range, while designators 506, 508 mark the lower (1710 MHz) and the upper (2170 MHz) extents of the upper frequency range, respectively. The curve with designator 512 corresponds to the measured response of the 4-band antenna described with respect to FIG. 3, supra. The curve marked with designator 510 depicts antenna response simulated using the matching circuit 200 of the embodiment of FIG. 2. A measured s-parameter of the circuit 200 was used in simulating the response 510.

Comparison between the two antenna responses 510, 512 demonstrates an increased antenna bandwidth in the lower frequency range for the response 510, which allows antenna operation in the 850 MHz and 900 MHz lower frequency bands.

The data presented in FIGS. 3-5 demonstrate that a loop or ring antenna configured with a narrow slot is capable of operation within a wide frequency range; i.e., covering the lower frequency band from 824 to 960 MHz, as well as the higher frequency band from 1710 MHz to 2170 MHz. This capability advantageously allows operation of a portable computing device with a single antenna over several mobile frequency bands such as GSM850, GSM900, GSM1900, GSM1800, PCS-1900, as well as LTE/LTE-A and/or WiMAX (IEEE Std. 802.16) frequency bands. Furthermore, the use of a separate tuning branch enables formation of a higher order antenna resonance, therefore enabling antenna operation in an additional high frequency band (e.g., 2500-2600 MHz band). Such capability further expands antenna uses to Wi-Fi (802.11) and additional LTE/LTE-A bands. As persons skilled in the art will appreciate, the frequency band composition given above may be modified as required by the particular application(s) desired, and additional bands may be supported/used as well.

Advantageously, the slotted loop or ring antenna configuration (as in the illustrated embodiments described herein) further allows for improved device operation by reducing potential for antenna shorting (and associated adverse effects) due to user handling, in addition to the aforementioned breadth and multiplicity of operating bands. Furthermore, the use a bottom-placed gap (for example, a small single gap as shown in the exemplary embodiments herein) improves device aesthetic appeal in that the bottom of the device is rarely if ever seen during use, and reduces the need for non-conductive or decorative covering elements (often required in prior art solutions), thereby reducing the device cost as well.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A multiband antenna apparatus for use in a portable radio communications device, the antenna apparatus comprising:

a first antenna structure comprising an element configured to be disposed around an external surface of a device enclosure;

wherein:

the first antenna structure is connected to a ground plane of the device in at least two locations in order to form a virtual portion and an operational portion; and the operational portion comprises a slot formed in the element so as to be disposed proximate a bottom side of the device enclosure, the slot further dividing the operational portion into a longer section and a shorter section; and a plurality of tuning branches with at least one of the tuning branches coupled to a feed port of the portable radio communications device, the plurality of tuning branches collectively configured to effectuate a plurality of resonances within the longer section and the shorter section of the operational portion.

2. The antenna apparatus of claim 1, wherein the slot is configured to effect antenna resonance in at least one upper frequency band.

3. The antenna apparatus of claim 1, further comprising a second antenna structure comprised of the plurality of tuning branches, the plurality of tuning branches collectively comprising a plurality of monopole radiator branches, where the plurality of monopole radiator branches comprises:

a first radiator branch electrically coupled to the feed port of the device, and configured to operate in a first upper frequency band;

a second radiator branch coupled to the feed port of the device, and configured to operate in a second upper frequency band; and a third radiator branch electrically coupled to the feed port of the device, and configured to operate in a first lower frequency band.

4. The antenna apparatus of claim 3, wherein:

an exterior perimeter of the virtual portion substantially envelops the ground plane; and an exterior perimeter of the second antenna structure is disposed external to the ground plane.

5. The antenna apparatus of claim 3, further comprising a reactive circuit coupled between the third radiator branch and the feed port.

6. The antenna apparatus of claim 5, wherein the reactive circuit comprises: (i) a capacitive element; and (ii) an inductive element.

7. The antenna apparatus of claim 5, wherein a second reactive circuit is configured to adjust an electrical length of the third radiator branch.

8. The antenna apparatus of claim 5, wherein the first lower frequency band comprises a GSM band, and the first and the second upper frequency bands are selected from a group consisting of 1700 MHz, 2100 MHz, and 2500 MHz bands.

9. The antenna apparatus of claim 3, wherein the slot is disposed proximate a lower corner of the device enclosure.

10. The antenna apparatus of claim 1, wherein the at least two locations are configured to affect an electrical length of the element.

11. The antenna apparatus of claim 10, wherein the at least two locations comprise (i) a first ground structure disposed on a first side of the element, and (ii) a second ground structure disposed on a second side of the element, the second side opposes the first side, such that the first ground structure and the second ground structure are configured distant to the slot.

12. The antenna apparatus of claim 1, wherein a portion of the element is disposed proximate the bottom side and is spaced from the ground plane along substantially a lateral extent of the bottom side.

13. A method of operating a multiband antenna apparatus for use in a portable radio device, the apparatus having a feed, a loop radiator element disposed around a perimeter region and on an external surface of an enclosure of the device, the loop radiator element having a slot disposed substantially at a bottom edge of the enclosure, and a ground plane of the radio device disposed a distance away from a bottom edge of the loop radiator element, the method comprising;

energizing the feed with a feed signal comprising a lower frequency component and a higher frequency component; and causing radio frequency oscillations in the loop radiator element at least at the higher frequency via use of one or more tuning branches coupled to the feed, the one or more tuning branches disposed adjacent the loop radiator element;

wherein, the slot is configured to effect tuning of the antenna apparatus at the higher frequency.

14. A mobile device, comprising:

a device enclosure; and an antenna comprising:

an external radiator element, the external radiator element having at least one slot disposed relative to the device enclosure so as to minimize potential for the external radiator element shorting across the slot due to the device being handled by a user during use of the device; and a plurality of tuning branches with at least one of the tuning branches coupled to a feed of the mobile device, the plurality of tuning branches configured to effectuate a plurality of resonances within respective portions of the external radiator element.

15. The mobile device of claim 14, wherein the external radiator element comprises a substantially closed loop, and the at least one slot comprises a single slot disposed substantially on a bottom edge of the device enclosure of the device, the bottom edge being not normally grasped by the user when in use of the device.

16. The mobile device of claim 14, wherein:

the external radiator element comprises a substantially closed loop disposed on a top edge, a bottom edge, and side edges of the device enclosure of the mobile device; and the at least one slot comprises a single slot disposed at either one of the top edge or the bottom edge.

17. The mobile device of claim 14, wherein:

the external radiator element comprises a first structure being connected to a ground plane of the device in at least two locations so as to form a virtual portion and an operational portion; and the slot is disposed in the operational portion on a bottom side of the device enclosure.

18. The mobile device of claim 17, wherein the plurality of tuning branches collectively comprise a plurality of monopole radiator branches.

19. The mobile device of claim 18, wherein an exterior perimeter of the operational portion is disposed external to the ground plane, and substantially envelops the plurality of monopole radiator branches.

20. The mobile device of claim 18, wherein the plurality of monopole radiator branches comprises:

a first radiator branch electrically coupled to a feed port of the device, and configured to operate in a first frequency band;

a second radiator branch coupled to the feed port of the device, and configured to operate in a second frequency band; and a third radiator branch electrically coupled to the feed port of the device, and configured to operate in a third frequency band.

21. The mobile device of claim 20, wherein each of the plurality of monopole radiator branches comprises a conductive strip having at least one turn.

22. The mobile device of claim 21, wherein the at least one turn forms at least a portion of a C-shaped structure.

23. The mobile device of claim 20, wherein the third radiator branch is further configured to operate in a fourth frequency band having a resonance proximate a harmonic of a resonance of the third frequency band.

24. The mobile device of claim 20, wherein:

the external radiator element comprises a substantially closed loop; and the second radiator branch is electrically coupled to the loop proximate the slot.

25. The mobile device of claim 20, wherein:

the radiator element comprises a substantially closed loop element; and the second radiator branch is electromagnetically coupled over a non-conductive gap to the loop element proximate the slot.

26. The mobile device of claim 14, wherein the radiator element comprises a substantially closed loop, the loop forming a single contiguous structure.

27. The mobile device of claim 14, wherein at least one of the plurality of tuning branches is electrically isolated from the external radiator element.

28. The mobile device of claim 27, wherein the electrical isolation between the at least one tuning branch and the external radiator element is effectuated by a layer of dielectric material.

29. The mobile device of claim 28, wherein the at least one tuning branch is capacitively coupled to the external radiator element over one or more non-conductive gaps.

* * * * *